United States Patent [19]

Kostecki

[11] 3,985,080

[45] Oct. 12, 1976

[54] TWO SELECTOR GATE FOR ACTIVE-PASSIVE RADIO PROXIMITY FUZES

[75] Inventor: Raymond T. Kostecki, Chicago, Ill.

[73] Assignee: The United States of America as represented by the Secretary of the Navy, Washington, D.C.

[22] Filed: Oct. 30, 1967

[21] Appl. No.: 679,261

[52] U.S. Cl. ..... 102/70.2 P; 343/7 PF

[51] Int. Cl.[2] ..... F42C 13/04

[58] Field of Search ..... 102/70.2 P; 343/7 PF

[56] References Cited

UNITED STATES PATENTS

| | | | |
|---|---|---|---|
| 3,123,821 | 3/1964 | Huntoon | 102/70.2 P |
| 3,131,388 | 4/1964 | Baker | 102/70.2 P |
| 3,219,826 | 11/1965 | Leton, Jr. | 102/70.2 P |
| 3,326,130 | 6/1967 | Baker | 102/70.2 P |

*Primary Examiner*—Verlin R. Pendegrass

*Attorney, Agent, or Firm*—Richard S. Sciascia; Joseph M. St.Amand; T. M. Phillips

[57] ABSTRACT

A device for use in an active-passive fuzing system to guard against the malfunctioning of the fuze due to jamming signals transmitted by the target. A gate circuit is utilized to prevent an enabling signal to be passed to the warhead detonator until there is jamming signal fall-off in the guard detector and there is an increase in signal strength in the passive detector.

5 Claims, 4 Drawing Figures

RAYMOND T. KOSTECKI
INVENTOR.

BY R. M. Phillips
J. M. St. Amand
ATTORNEYS

NOTE:
ALL CAPACITORS IN μF AND
ALL RESISTORS 1/2 WATT
UNLESS OTHERWISE NOTED

RAYMOND T. KOSTECKI
INVENTOR.

BY T. M. Phillips
J. M. St. Amand
ATTORNEYS

RAYMOND T. KOSTECKI
INVENTOR.

BY R. M. Phillips
J. M. St. Amand
ATTORNEYS

TWO SELECTOR GATE FOR ACTIVE-PASSIVE RADIO PROXIMITY FUZES

The invention herein described may be manufactured and used by or for the Government of the United States of America for governmental purposes without the payment of any royalties thereon or therefor.

BACKGROUND OF THE INVENTION

The present invention relates to radio proximity fuzes and more particularly to an active-passive radio proximity fuze employing a coincidence gate to insure activating the fuze only when it is sufficiently close to the target to destroy the target. Normally, an active passive proximity fuze employs three receiver channels. An active receiver channel senses the presence of signals reflected from the target when the target appears within the lethal volume surrounding the warhead of the missile and is the channel which generates the firing signal to detonate the warhead. The second of the three receiver channels is the guard channel and it employs a receiving antenna whose beam pattern is tilted more forward (in the direction of the missile line of flight) than the active channel antenna beam pattern. The guard channel can then sense the presence of a jammer equipped target some time before the target appears in the lethal volume. The beam pattern configuration is such that a pronounced decrease in gain occurs at the fuze-to-target angle when the target is about to appear in the lethal volume about the warhead.

The third receiver or passive channel, unlike the active channel, responds to a jamming signal in order to initiate detonation of the warhead. The passive channel receives signals from the same antenna that is employed with the active channel, and may share some other components with the latter, such as the mixer and intermediate frequency amplifier. Like all antennas, the antenna employed with these two channels has a number of minor lobes about its main beam. The minor lobes that are pointed in the direction of flight of the missile sense the jamming energy emanating from the target long before the target appears within the lethal volume. Because the passive channel responds to jamming signals, it must be maintained in a disabled state until the target appears within the lethal volume of the missile in order to prevent detonation of the warhead prematurely.

As the missile approaches the jammer equipped target, the signal within the guard channel is continually rising because of the closing distance. The guard channel is equipped with an automatic gain control (AGC) system in order to accommodate the wide amplitude range of signals anticipated. Eventually, the signal within the guard channel attains an amplitude sufficient to close a relay, which then completes the path between the passive channel detector and the firing circuit. The firing circuit is employed for the purpose of initiating warhead detonation by signals from the passive channel. The passive channel is now activated. Closure of the relay also results in the application of AGC potentials from the guard channel to the passive channel. The sensitivity of the passive channel is thereby reduced, preventing response to jamming signals sensed by the front minor lobes of the antenna. Preventing response to jamming signals at this time is necessary because detonation would be premature, as the missile and target are too far away from each other.

The guard channel antenna pattern configuration is such that when the missile arrives close to the target, the signal within the guard channel decreases, because of a decrease in antenna gain at the missile-to-target angle. The AGC potential applied to the passive channel also decreases, and the sensitivity of the channel rises.

When the lethal volume of the warhead envelops the target, the jamming signal emanating from the target enters the passive channel by way of the major lobes of the antenna and is applied to the firing circuit. Because the sensitivity of the passive channel had previously been increased, and because of the higher gain of the antenna major lobes, the signal at the firing circuit is sufficient to initiate detonation of the warhead and the target is destroyed. Thus, the successful operation of the passive portion of the fuze is dependent upon a decrease of guard antenna gain, due to the geometry of approach near the lethal volume, followed by an increase in active-passive antenna gain when the missile arrives at its destination.

The prior known systems have the inherent disadvantages of the passive channel becoming activated long before the missile arrives near enough to destroy the target and is maintained in only a partially disabled state by the AGC system throughout a substantial portion of the flight of the missile. This allows the warhead to be vulnerable to premature detonation for a comparatively long time.

The magnitude of AGC potential is not the same for jamming signals bearing different types of modulation, for the same average jammer power. Consequently, the degree of passive channel desensitization is different for various types of jamming signal modulation. This has resulted in premature detonation of the warhead, that is, detonation long before the missile had arrived at its destination. Activation of the passive channel is dependent to some degree upon the type of modulation impressed upon the jamming signal. For some types of modulation, the passive channel is never activated, but the active channel has been desensitized sufficiently by the jamming signal so that it also becomes ineffective in initiating warhead detonation, and the target is not destroyed.

For some types of jamming signal modulation, premature detonation occurs because the AGC potential is unable to follow the jamming signal amplitude changes, and consequently the passive channel is inadequately desensitized. The successful operation of the passive system is dependent upon the absolute gains of the active-passive and guard antennas. The absolute gains of the two antennas are not the same at different rotational angles of the missile. At some rotational angles, the two antenna gains are such that the signal delivered to the firing circuit is insufficient to cause warhead detonation.

SUMMARY

The present invention provides a two selector gate circuit which utilizes the jamming signal to initiate detonation of the warhead when the missile passes sufficiently close to the jammer equipped target and overcomes the above mentioned disadvantages for the following reasons:

The passive channel is activated only when the jamming signal is received by the antenna on its major lobe, that is, when the missile and target are in a position such that the target can be destroyed. The passive channel is completely inoperative during flight before the missile arrives at its destination. Premature detonation by signals from the passive channel therefore cannot occur. AGC is not employed for the purpose of partially disabling the passive channel. This eliminates the difficulties encountered with AGC potential levels that differ because of various types of jamming signal modulation. AGC is employed in the guard channel receiver, but only for the purpose of enabling the receiver to accommodate the wide amplitude range of signals anticipated. The AGC is not used as a control parameter for the passive channel. Rigid control of absolute antenna gain is not necessary for desired passive channel operation, because only changes in antenna gains are utilized.

Many of the attendant advantages of this invention will become readily appreciated as the same becomes better understood by reference to the following detailed description when considered in connection with the accompanying drawings wherein.

Figure 1:
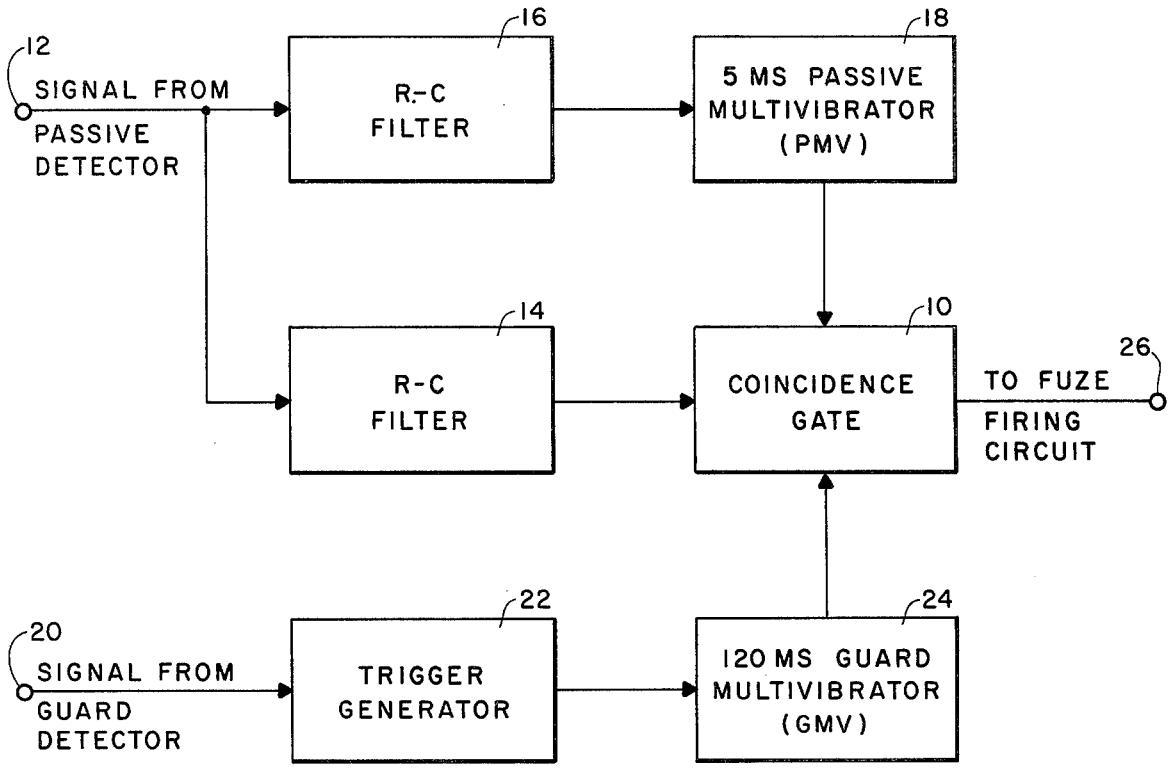
FIG. 1 is a block diagram of a preferred embodiment of the invention.

Referring now to the drawings there is shown in FIG. 1 a coincidence gate 10. Signals received at terminal 12 from the passive channel detector (not shown) are fed through R-C filter circuit 14 to gate 10 and through R-C filter circuit 16 to multivibrator 18. The output of multivibrator 18 is coupled as an input to gate 10. Signals received at terminal 20 from the guard channel detector (not shown) are fed to trigger generator 22 which produces a trigger for guard multivibrator 24. The output of multivibrator 24 is coupled as an input to gate 10.

Figure 4:
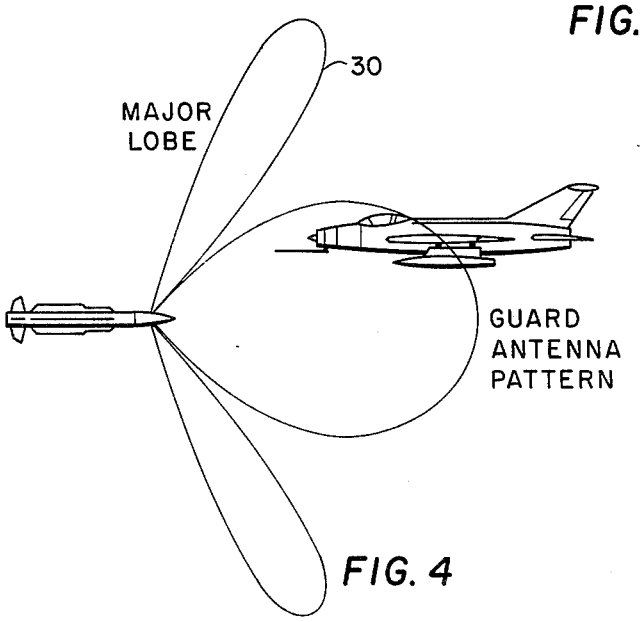
FIG. 4 is a diagram showing the geometrical relationshp between the missile and target.

In operation gate 10 is normally disabled and cannot pass signals to terminal 26. Jamming signals received from the guard antenna (Not shown. Antenna pattern is shown in FIG. 4.) at terminal 20 are applied to trigger generator 22 and gradually rises in amplitude as the missile closes on the target. Trigger generator 22, which will be described more fully below, does not respond to signals of increasing amplitude. When the missile-to-target geometry is such that the signal received at terminal 20 decreases in amplitude, a trigger pulse will be generated by trigger generator 22 and fed to guard multivibrator 24. Guard multivibrator 24 may be a monostable multivibrator of conventional design and for illustrative purposes is shown to have a period of approximately 120 ms. The resulting 120 ms pulse is applied to gate 10 and is the first of the three signals required to enable gate 10.

When the target appears in the lethal volume, an abrupt increase of signal occurs at the passive terminal 12 because of the high gain and narrow beam width of the active-passive antenna major lobe 30 (FIG. 4). The rapid increase of signal at terminal 12 triggers passive multivibrator 18 which is of the monostable type and yields a pulse of approximately five ms duration. The output pulse from multivibrator 18 is applied to gate 10 and is the second of the three signals required.

The increased passive signal at terminal 12 is applied as the third enabling signal to gate 10 after it has been filtered by R-C filter 22. With the three signals present as described above, gate 10 is enabled and the passive signal from terminal 12 is passed to output terminal 26.

For all types of jamming signal modulation, the signals appearing at terminals 12 and 20 appear as noise. This is a natural consequence of the manner in which the fuze local oscillator is intentionally modulated. The noise components are filtered out by means of R-C filters 16 and 22 and only the signal modulation envelopes are retained for triggering multivibrators 18 and 24. Because of the necessary filtering employed, the output pulses of multivibrators 18 and 24 may overlap slightly for some types of jamming modulation, i.e., one multivibrator may be triggered on just before the other is triggered off. Premature detonation is prevented by the requirement that gate 10 must receive the third or passive signal in addition to signals from multivibrators 18 and 24.

Figure 2:
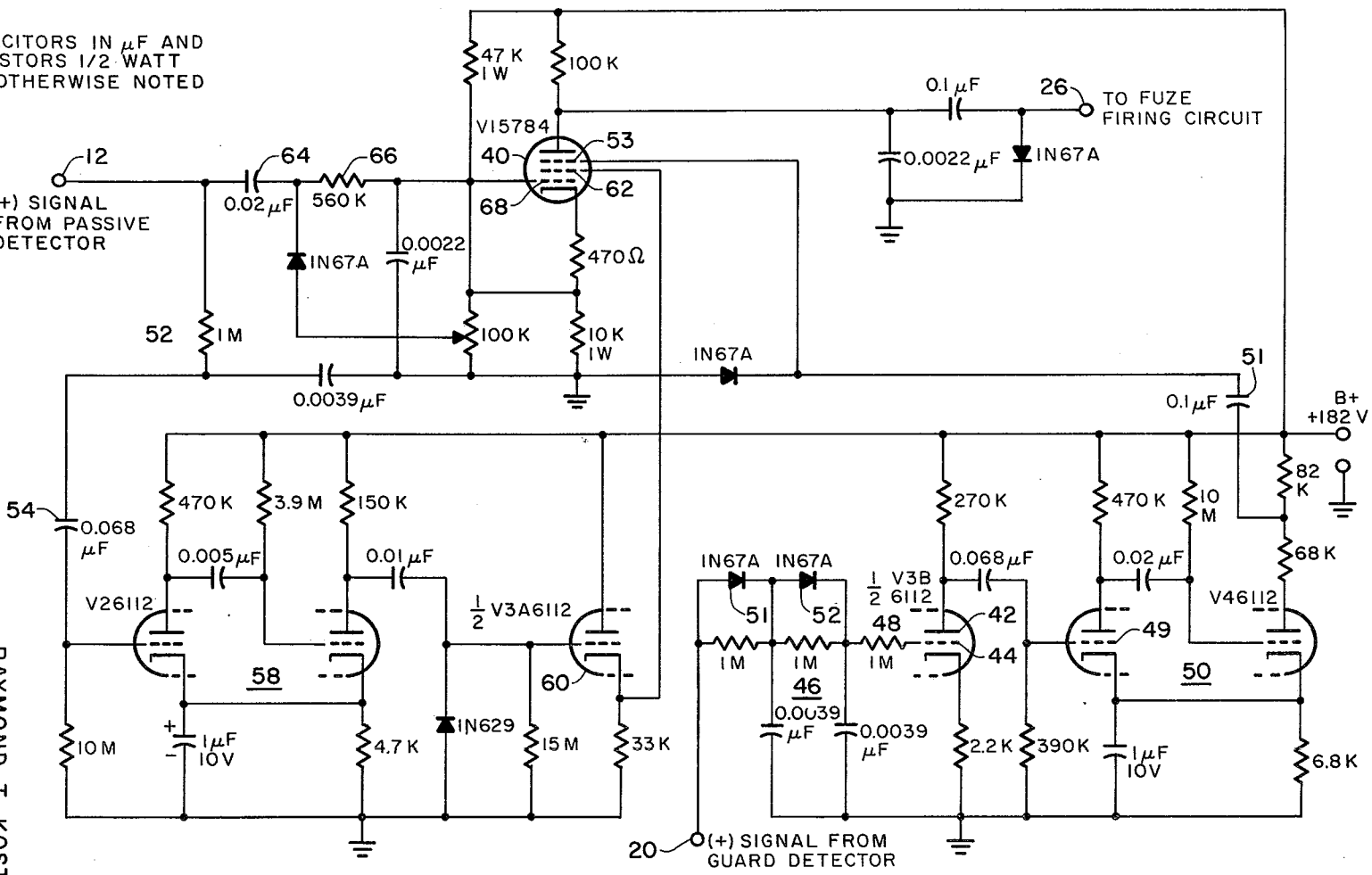
FIG. 2 is a vacuum tube schematic diagram of FIG. 1.

Referring to FIG. 2, tube 40 with its associated components is the coincidence gate 10 of FIG. 1. Tube 40 is of the type in which plate current can be maintained at cutoff by a suitable negative potential at any one of the three grids, regardless of the potential at the other two grids. All three grids are maintained at plate current cutoff by a positive, B+, potential applied to the cathode. When tube 40 is enabled, signals for the firing circuit appear at terminal 26.

Trigger generator 22 is comprised of tube 42 with its associated components. Positive signals received at terminal 20 are applied to grid 44 through R-C filter 46. The resulting negative signal at plate 48 is coupled to grid 49 of multivibrator 50. Multivibrator 50 does not produce an output pulse since a positive signal at grid 49 is required. A decrease of signal at terminal 20 will cause a positive signal at plate 48. Diodes 51 and 52 permit multivibrator 50 to be interrupted should a jamming signal reappear at terminal 20. The output pulse generated by multivibrator 50 is coupled through coupling capacitor 51 to grid 53 of tube 40.

Signals received at terminal 12 are coupled through resistor 52 and capacitor 54 to grid 56 of multivibrator 58. The output pulse generated by multivibrator 58 is coupled through cathode follower 60 to grid 62 of tube 40. The passive signal is also coupled through capacitor 64 and resistor 66 to grid 68 of tube 40.

Figure 3:
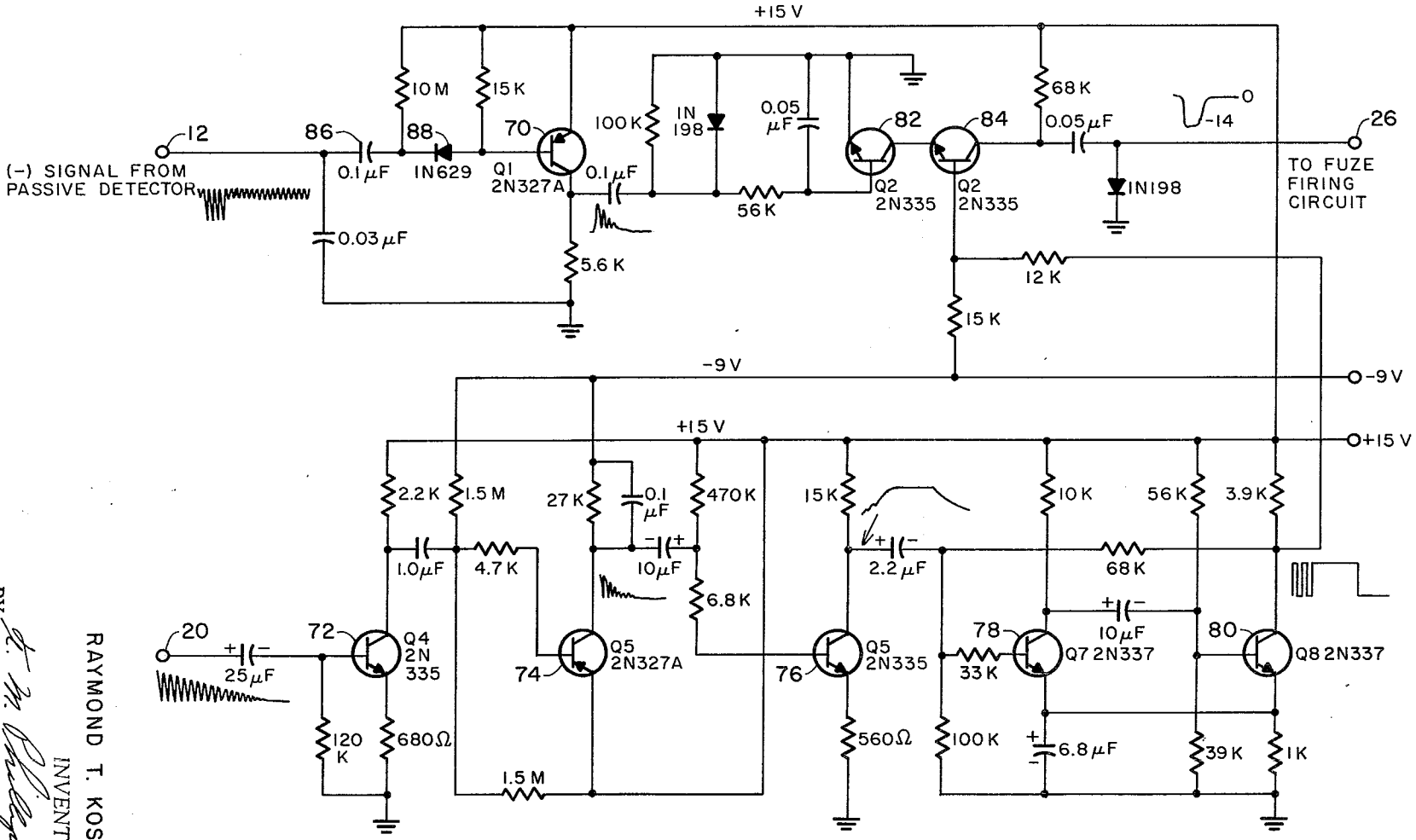
FIG. 3 is a transistor schematic diagram of FIG. 1.

FIG. 3 is a transistorized embodiment of the invention and is similar to the vacuum tube embodiment of FIG. 2 except that the passive multivibrator 58 has been replaced by a threshold amplifier 70. Referring to FIGS. 1 and 3, trigger generator 22 (FIG. 1) is comprised of transistors 72, 74, and 76 with their circuitry. Guard multivibrator 24 (FIG. 1) is comprised of transistors 78 and 80 with their circuitry and coincidence gate 10 (FIG. 1) is comprised of transistors 82 and 84 with their circuitry.

The passive multivibrator 58 of FIG. 2 generates a pulse when a signal having an abrupt increase is received at terminal 12. In contrast, transistor 70 should normally operate at collector current cutoff. A sudden increase of signal at terminal 12 supplies base current bias for transistor 70 and an amplified signal appears at its collector. Capacitor 86 becomes charged through diode 88 and the parallel impedance of resistor 90 and the base-emitter junction of transistor 70. If the signal at terminal 12 is varying slowly in amplitude, base current bias for transistor 70 is blocked by diode 88 which had become reverse biased by the potential to which capacitor 86 had previously become charged by the signal. As a result, no signal appears at the collector circuit of transistor 70 unless an abrupt signal increase occurs which is greater in amplitude than the potential to which capacitor 86 had been charged. The output signal from transistor 70 is coupled to the base of transistor 82 while the output signal from transistor 72 is coupled to the base of transistor 84 and when they are both present an output signal will appear at terminal 26.

The values and components shown in FIGS. 2 and 3 have been found satisfactory in practicing the invention.

What is claimed is:

1. A two selector gate for use in active-passive radio proximity fuzes, the combination comprising:

a. a first input terminal for receiving input signals representing the presence of a target, b. a second input terminal for receiving input signals representing the presence of jamming signals.

c. a coincidence gate circuit having first, second, and third inputs and an output, d. a first pulse generating means coupled to said first input terminal and to the first of said inputs of said coincidence gate circuit for providing a first enabling pulse to said coincidence gate circuit in response to a sharp increase in signal strength at said first input terminal, e. a second pulse generating means coupled to said second input terminal and to the second input of said coincidence gate circuit for providing a second enabling pulse to said coincidence gate circuit in response to a decrease in signal strength at said second input terminal, f. filter circuit means coupling said first input terminal to the third input of said coincidence gate circuit for coupling a signal having a sharp increase in signal strength to the third input of said coincidence gate circuit, g. said coincidence gate circuit being responsive to the simultaneous presence of said first pulse, said second pulse, and said third input signal for passing said third input signal to the output of said coincidence gate circuit.

2. The two selector gate of claim 1 wherein said first pulse generating means is a monostable multivibrator.

3. The two selector gate of claim 1 wherein said second pulse generating means is a monostable multivibrator.

4. The two selector gate of claim 1 wherein said first pulse generating means is a threshold amplifier.

5. The two selector gate of claim 4 wherein said threshold amplifier comprises:

a. a transistor having a base, collector, and emitter, b. a diode having its anode coupled to the base of said transistor, c. a capacitor coupling the cathode of said diode to said first input terminal, d. and a resistor coupled between the base and emitter of said transistor.

* * * * *